US007121285B2

(12) United States Patent
Kraus

(10) Patent No.: US 7,121,285 B2
(45) Date of Patent: Oct. 17, 2006

(54) CURLING ELEMENT FOR STYLING HAIR AND FIXING ELEMENT FOR A CURLING ELEMENT

(76) Inventor: Ursula Kraus, Via Borgogna 7 1-20121, Mailand (IT)

( * ) Notice: Subject to any disclaimer, the term of this patent is extended or adjusted under 35 U.S.C. 154(b) by 0 days.

(21) Appl. No.: 10/333,544

(22) PCT Filed: May 18, 2001

(86) PCT No.: PCT/DE01/01901

§ 371 (c)(1),
(2), (4) Date: Nov. 18, 2003

(87) PCT Pub. No.: WO02/07569

PCT Pub. Date: Jan. 31, 2002

(65) Prior Publication Data

US 2004/0069316 A1 Apr. 15, 2004

(30) Foreign Application Priority Data

Jul. 21, 2000 (DE) ..... 200 12 788 U
Dec. 6, 2000 (DE) ..... 200 20 782 U

(51) Int. Cl.
*A45D 2/08* (2006.01)
*A45D 2/14* (2006.01)

(52) U.S. Cl. ..... 132/250; 132/268

(58) Field of Classification Search ..... 132/245, 132/246, 247, 248, 250, 268; D28/37
See application file for complete search history.

(56) References Cited

U.S. PATENT DOCUMENTS 731,861 A * 6/1903 Connell ..... 132/245
1,085,083 A * 1/1914 Grosert ..... 132/245
1,495,054 A * 5/1924 West ..... 132/250
1,985,472 A * 12/1934 Tubbs ..... 132/237
2,120,689 A * 6/1938 Walker ..... 408/155
2,507,356 A * 5/1950 Steiner et al. ..... 132/247
2,754,832 A * 7/1956 Garland ..... 132/246
2,796,872 A * 6/1957 Mussy ..... 132/251
2,838,054 A * 6/1958 Fischer ..... 132/246
2,896,638 A * 7/1959 Korsmo ..... 132/248
3,045,685 A * 7/1962 Cormier ..... 132/250
3,144,027 A * 8/1964 Chalfin et al. ..... 132/245
4,211,245 A * 7/1980 Coppola et al. ..... 132/268
4,974,613 A * 12/1990 Ho ..... 132/259
5,215,107 A 6/1993 Van Divner
5,979,465 A * 11/1999 Marrese et al. ..... 132/248
6,000,201 A * 12/1999 Nippes et al. ..... 53/544
6,186,150 B1 * 2/2001 Lo ..... 132/269
2003/0089380 A1 * 5/2003 Catini ..... 132/248

FOREIGN PATENT DOCUMENTS

CH 597 788 4/1978
DE 858 009 12/1952
EP 0 283 305 9/1988

(Continued)

*Primary Examiner*—Todd E. Manahan
(74) *Attorney, Agent, or Firm*—Flynn, Thiel, Boutell & Tanis, P.C.

(57) ABSTRACT

Various shaped curling elements provide flexibility for hair-styling. A fixing element ensures that curling elements are simply and reliably prevented from unrolling once they have been rolled up. The curling element includes at least one ring-shaped notched section made in a cylindrical base form. The bottom of the at least one notched section and the transitions between the ring-shaped notched section and the lateral surface of the cylinder are rounded off.

12 Claims, 7 Drawing Sheets

FOREIGN PATENT DOCUMENTS

| | | |
|---|---|---|
| EP | 0 890 325 | 1/1999 |
| GB | 2 107 581 | 5/1983 |

* cited by examiner

CURLING ELEMENT FOR STYLING HAIR AND FIXING ELEMENT FOR A CURLING ELEMENT

FIELD OF THE INVENTION

The present invention relates to a curling element for styling hair and to a retaining element for a curling element.

BACKGROUND OF THE INVENTION

The applicant is aware of curling elements having a cylindrical shape. The cylindrical lateral surface has provided thereon tips or peaks for ensuring a better grip for the hair when the curling elements are rolled into the hair After having been rolled into the hair, the curling elements can be retained by the measure that a rubber is stretched from the one end of the cylinder to the other end for retaining the curling element together with the rolled-up hair.

It is the object of the present invention to provide curling elements with which hairstyles can be made more flexible. Furthermore, a retaining element is suggested for preventing the curling elements in a simple and reliable way from unrolling after said curling elements have been rolled up.

SUMMARY OF THE INVENTION

According to the present invention, a curling element has at least one ring-shaped notch formed in a cylindrical basic form, the bottom of the at least one ring-shaped notch and the transitions of the ring-shaped notch into a cylindrical lateral surface being rounded off.

The rounding off has the advantage that there are no edges in the curling element where the hair may break when placed around the curling elements while the elements are being rolled up.

Furthermore, such a rounding off can effect a smooth transition. The hair that is wound into the notch is afterwards curled with a smaller diameter. It is e.g. possible to wind a hair strand around the curling element starting from the hairline in that the hair is first placed around that portion of the curling element that has no notch. Towards the end of the hair strand the hair is placed into the notch. This results in curls having a smaller diameter in the area of the hair tip.

Accordingly, a handling in the reverse order is also conceivable, i.e. the curls terminate downwards in a hair strand when, starting at the hairline, the hair is placed into the notch.

When the curling element comprises several notches, it is possible to change the diameter of the curls in a hair strand several times by either putting or not putting the hair of the hair strand along the hair strand into a notch.

In the curling element, the cylindrical lateral surface is provided with a taper at its ends.

The curling element can thereby be used for rolling up the hair up to its end. Advantageously, the hair that is wound up at the end of the curling element can then be wound again with a smaller diameter.

In the design of the curling element, the transitions of the at least one ring-shaped notch into the cylindrical lateral surface are designed such that at least essentially an ellipsoid is obtained between two ring-shaped notches or between one ring-shaped notch and an end of the curling element.

This yields a particularly homogeneous transition in the curling element from portions having a larger diameter to portions having a smaller diameter. The transition of the curls within a hair strand can then be made homogeneous.

The ellipsoid may e.g. be a sphere.

The ellipsoid may be arranged between two notches and/or between a notch and an end of the curling element.

In one design, the at least essentially resulting ellipsoid is flattened at two opposite sides.

Advantageously, a broader structure can thereby be produced when the hair is placed around the curling element.

In one design, the radius of the cylindrical lateral surface tapers from the one end of the curling element to the other end.

For instance, several ellipsoids may be arranged on the cylindrical lateral surface. The ellipsoids will then have radii differing from the one end to the other end such that the radii are decreasing. This will also produce improved structures in the individual hair strands again.

In a further inventive curling element, the radius of the cylindrical lateral surface tapers towards one end.

Advantageously, it is thereby possible to vary the radius of the curls within one hair strand in that the hair strand is wound accordingly onto the curling element. The taper may e.g. concern only half the curling element. Advantageously, curls of a constant diameter can be produced when the hair is wound onto the cylindrical member. When the hair of the hair strand is wound onto the conical member, it is possible to produce curls having a smaller diameter. Optionally, it is again possible to choose the reduced diameter at the beginning of the hair strand on the hairline or at the end of the hair strand.

In the curling element, the radius of the cylindrical lateral surface can taper from one end to the other end.

Advantageously, this has the effect that the diameter of the curls in a hair strand will change continuously when the hair strand is wound onto the curling element.

In the design, the cylindrical lateral surface can be flattened at two opposite sides.

The structure of the curls as such can thereby be varied again.

In a further inventive solution, a helical notch which is rounded off in its bottom portion and in the transition to the cylindrical lateral surface is formed in the cylindrical basic form in a curling element.

It is thereby possible to vary the hair again within a hair strand with respect to the diameter of the curls. The notch need not extend over the whole length of the curling element. Rather, it is also possible that the notch will only begin on the curling element and also end on the curling element.

With such a curling element, the diameter of the curls can be flexibly reduced within a hair strand in an easy way, namely in the central portion of the hair strand, in that at the beginning said hair strand is placed around the cylindrical lateral surface and is then inserted into the notch in the course of its length, so that curls are formed there with a smaller diameter, and is then placed again around the cylindrical lateral surface.

The curling element, however, can also be used such that the diameter of the curls is only reduced at the beginning of the hair strand or at the end in that only a corresponding part of the curling element is used while the hair is being rolled up.

In the design, the radius of the cylindrical lateral surface can be tapered towards an end.

The diameter of the curls along the hair strand can thereby be varied again in addition in "superimposed" fashion.

In the above-described embodiments, an at least essentially cylindrical basic form exists even if the form becomes a truncated cone because of a taper. Likewise, this is even the case with a flattening existing at two or more sides.

A retaining element for a curling element consists of a bendable wire which is mounted on the curling element or passes through the curling element, the wire projecting beyond the ends of the curling element by at least a few centimeters.

Advantageously, this easily prevents a curling element from unrolling again after it has been rolled into a hair strand. This can be accomplished in that the retaining element is bent when the curling element has been rolled up. The retaining element will then rest on the head and prevent an unrolling of the curling element.

The wire which forms the retaining element can e.g. be surrounded by a plastic material to improve the wearing comfort and to prevent possible allergies to individual metals.

In the design, the retaining element consists of a copper wire.

Such a copper wire has already been produced for electrical installations and can thus be acquired at low costs. Wires having a cross-sectional area of 1.5 $mm^2$ and 2.5 $mm^2$, respectively, have turned out to be expedient. Furthermore, copper has the advantage that the wire is often bendable without breaking.

A retaining element can be realized such that the element has at least a member consisting of an elastic material, the member being adapted to be fastened to the retaining element and the curling element, respectively, or being retained by the retaining element and the curling element, respectively. The member in a relaxed state is at least almost entirely within the curling element, the member being extensible by a tensile load from the retaining element and the curling element, respectively, the member being adapted to be fastened in the extended state with its front end to the retaining element and the curling element, respectively, or being connectable to another member of the retaining element.

The elastic material the at least one member consists of may e.g. be rubber. The curling element may have a bore in its longitudinal direction. The member may be within the bore in the non-extended state. For mounting the curling element the member may be withdrawn and tensioned beyond the hair wound around the curling element and may be fastened at the other side of the curling element to the curling element itself or to the retaining element. The curling element can thereby be held.

It has been found to be particularly advantageous that the retaining element is almost imperceptible in the rolled-up state of the curling element. In the above-cited prior art the rubber band had to be fastened at both sides of the curling element after the curling element had been rolled up. This is difficult because the curling element had to be held at the same time to prevent unrolling. When the rubber band had been fastened at one side previously, this turned out to be a nuisance during rolling up. Hence, in the solution of the invention the retaining element is already fastened to the curling element in an advantageous manner without the retaining element presenting an obstacle during the rolling up of the curling element. This is due to the fact that in the relaxed state the retaining element is positioned within the curling element.

The retaining element comprises a tubular member having at least essentially a cylindrical shape, the at least one member being fastened or held in the area of an end of the tubular member, the latter being arranged in the curling element such that the tubular member extends at least essentially in the longitudinal direction of the curling element.

From a manufacturing point of view this embodiment is particularly simple to produce. The retaining element can first be produced and cast into the curling element during the production process of the curling element. It is also ensured thereby that the bore in the curling element is sufficiently large so that the member consisting of the elastic material finds enough accommodating space in the relaxed state.

DETAILED DESCRIPTION

Figure 1:
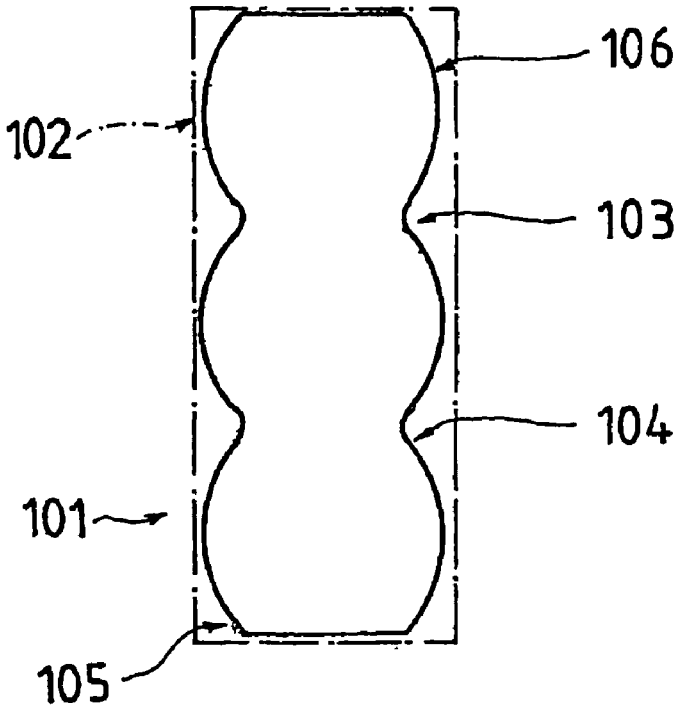
FIG. 1 illustrates a side view of a curling element of the invention.

FIG. 1 shows a curling element 101. The element has a substantially cylindrical basic form that is shown by the dash-dotted line 102 as an envelope of the curling element 101.

Ring-shaped notches 103, 104 are formed in the curling element 101. The ring-shaped notches 103 and 104 are each rounded off in the area of their bottom and in the transition to the cylindrical lateral surface.

As can also be seen, the cylindrical lateral surface 102 is respectively tapered in the area of its ends 105, 106.

Due to the rounding off of the notches 103 and 104 and the tapers in the area of the ends 105 and 106 of the cylindrical lateral surface 102, at least essentially an ellipsoid is formed between the two notches 103 and 104, between the notch 103 and the one end 106, and between the notch 104 and the other end 105.

As can be seen in the embodiment of FIG. 1, the ellipsoids may e.g. be spherical.

It is possible to give the ellipsoids different lengths. Consequently, the distances between the two notches 103 and 104 and between the notches 103 and 104 and the respective end 106, 105 of the cylindrical lateral surface 102 need not be the same.

Figure 2:
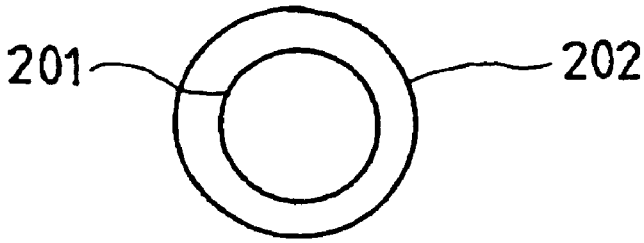
FIG. 2 is a top view of the curling element of FIG. 1.

FIG. 2 is a top view showing the curling element according to FIG. 1. The inner circle 201 shows the radius of the taper at the upper end 106. The larger circle 202 shows the radius of the ellipsoid between the upper end 106 and the notch 103.

Figure 3:
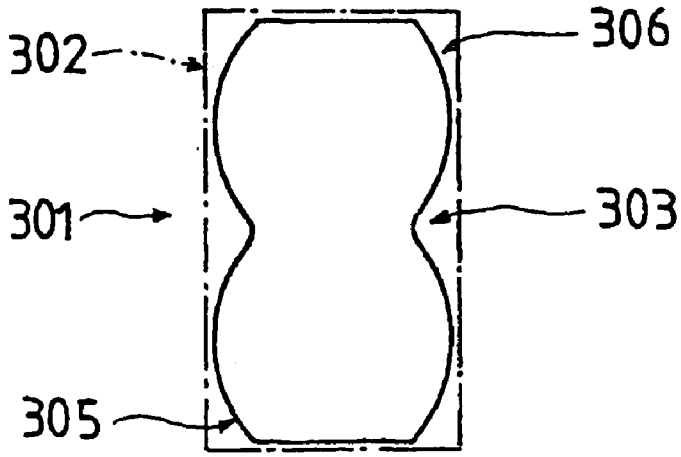
FIG. 3 illustrates a side view of a second embodiment of the curling element.

FIG. 3 shows a further embodiment of a curling element 301. The enveloping cylindrical lateral surface is designated by 302. In contrast to the curling element 101 according to FIG. 1, the curling element 301 has just one notch 303.

Figure 4:
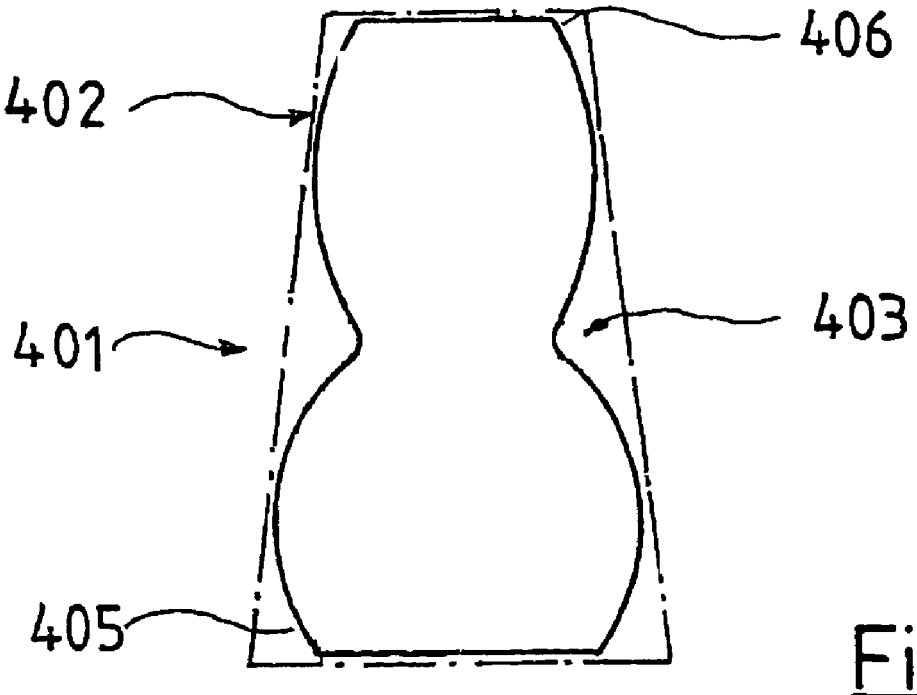
FIG. 4 illustrates a third embodiment of the curling element of the invention.

The curling element 301 is again tapered in the area of its ends 306 and 305. FIG. 4 shows a further curling element 401. The envelope 402 is a cylindrical lateral surface the radius of which is tapered along the cylindrical lateral surface. Hence, the envelope 402 has a frustoconical shape.

There is again a ring-shaped notch 403, as well as the tapers at ends 405 and 406. The transitions are again rounded.

The taper of the envelope 402 along the length of the cylinder has the effect that the two ellipsoids created by the notch 403 and the tapers provided at ends 405 and 406 have different radii along their length. This, in turn, makes it possible to vary the diameters of the curls accordingly when a strand of hair is being rolled up.

Figure 5:
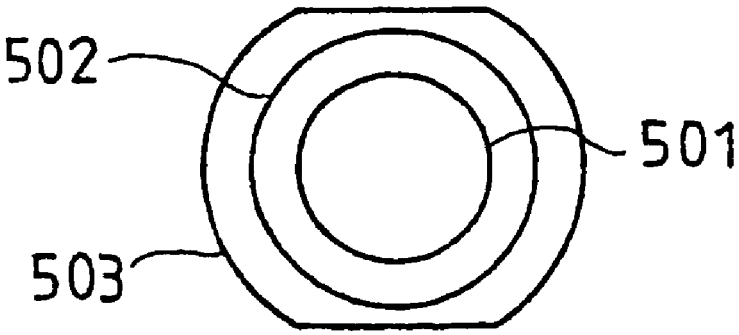
FIG. 5 is a top view of the curling element of FIG. 4.

FIG. 5 shows the curling element 401 according to FIG. 4 in a top view. The circle 501 corresponds to the radius at the upper end 406. The circle 502 corresponds to the radius of the upper ellipsoid formed by the taper at the upper end 406 and by the notch 403.

Line 503 is also shown to be substantially circular. The line corresponds to the circumferential line of the radius of the lower ellipsoid which is formed by the notch 403 and the taper at the lower end 405. It can further be seen that line 503 is shown to differ from a circular shape such that the lower ellipsoid is flattened at two opposite sides. The diameter of the curls can thereby be varied again while a hair strand is being wound up.

Likewise, it is possible to provide a corresponding flattening at the upper ellipsoid. The flattening may also be used in the other embodiments shown.

Figure 7:
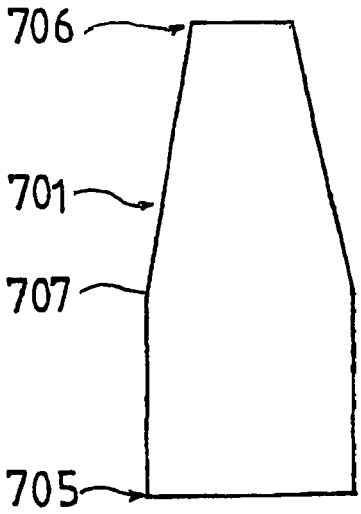
FIG. 7 illustrates a fourth embodiment of the curling element.

FIG. 7 shows a curling element 701. Starting at its one end 705, the curling element 701 is first provided with a cylindrical shape. Starting from a specific circumferential line 707, the radius of the cylinder tapers to the other end 706 of the curling element 701, so that a truncated cone is created, starting from the circumferential line 707.

It is then possible to wind part of the hair strand onto the cylindrical part of the curling element 701 and part of the hair strand onto the frustoconical part of the curling element 701. The radius of the resulting curls varies during winding of the hair strand on the frustoconical part of the curling element 701 in such a way that the radius of the curls is smaller in that part of the hair strand that was rolled up closer to the end 706 of the curling element 701.

Figure 6:
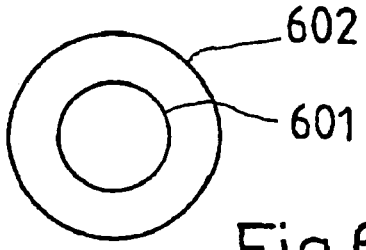
FIG. 6 is a top view of the curling element of FIG. 4.

FIG. 6 is a top view showing the curling element 701 of FIG. 7. The circle 601 corresponds to the radius at the upper end 706 of the curling element 701. The circle 602 corresponds to the radius on the circumferential line 707 that corresponds to the radius at the lower end 705.

Figure 9:
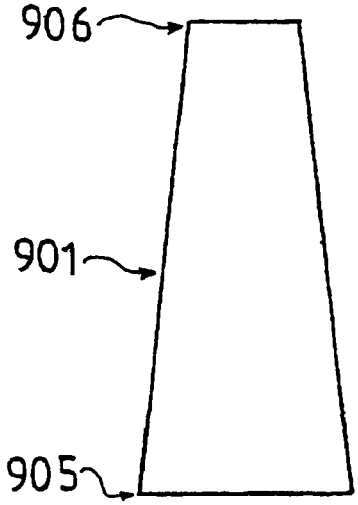
FIG. 9 shows another embodiment of the curling element.

FIG. 9 shows a further curling element 901. The curling element 801 is tapered, starting from its lower end 905 to the other end 906, so that the curling element 901 has a frustoconical shape.

Figure 8:
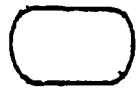
FIG. 8 is a top view of the outer shape at the upper end of the curling element of FIG. 9.
Figure 10:
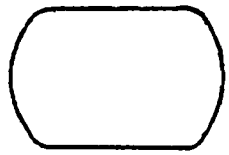
FIG. 10 is a bottom view of the lower end of the curling element of FIG. 9.

FIG. 8 is a top view showing the outer shape at the upper end 906. FIG. 10 is a top view on the lower end 905 of the curling element 901. As can be seen from the illustrations of FIGS. 8 and 10, the curling element 901 is flattened on both side surfaces.

It is e.g. also possible to provide a corresponding flattening in the curling element 701.

Figure 11:
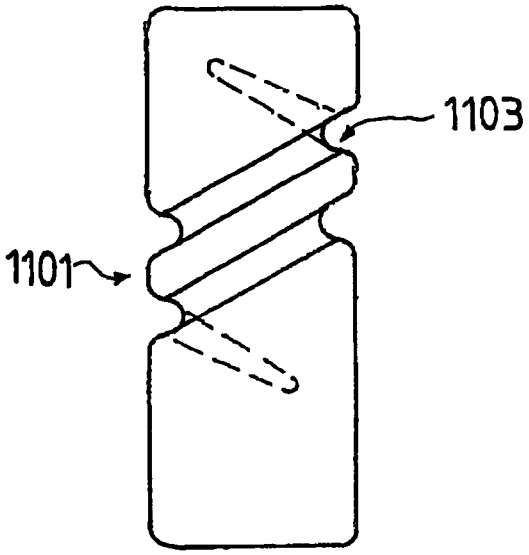
FIG. 11 shows a further embodiment of the curling element.

FIG. 11 shows a further curling element 1101. The curling element 1101 has a cylindrical basic shape. A helical notch 1103 is provided on a surface. The helical notch does not extend over the whole surface of the curling element 1101, but only over a part thereof. Advantageously, the notch 1103 is shaped at its ends such that it passes continuously into the cylindrical lateral surface. As can further be seen, the lateral borders of the notch 1103 are also rounded off.

Figure 12:
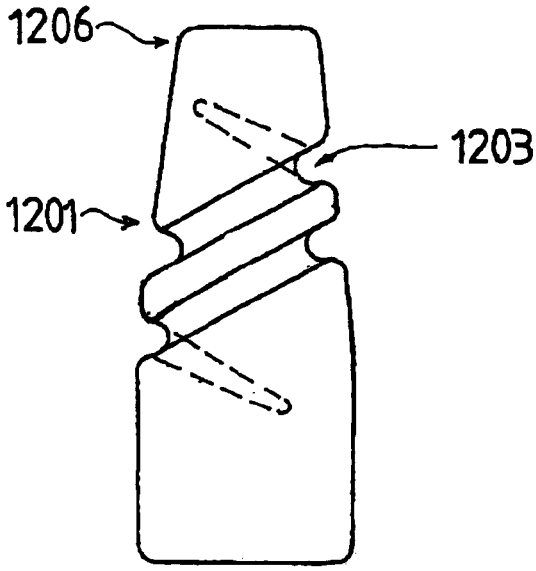
FIG. 12 shows yet another embodiment of the curling element.

FIG. 12 shows a curling element 1201 with a notch 1203. In contrast to FIG. 11, the cylindrical basic form of the curling element 1201 tapers towards the one end 1206 thereof.

Figure 13:
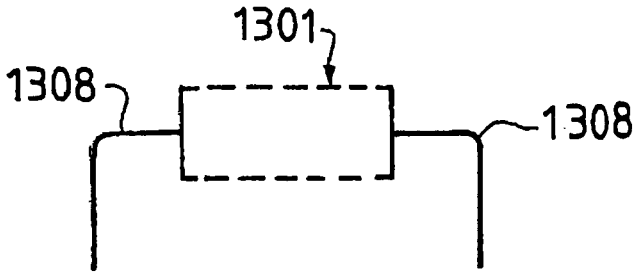
FIG. 13 shows the curling element with a retaining element.

FIG. 13 shows a curling element 1301. At each of its two ends the curling element 1301 has an extension 1308 which acts as a retaining element. The extension 1308 is flexible, remaining stable in the bent form. For example, the extension may consist of a copper wire which is surrounded by a plastic material. Such a copper wire is e.g. known from electrical installations. Cross-sectional areas of the copper wire in the order of 1.5 $mm^2$ have turned out to be useful.

The copper wire may be fastened to the ends of the curling element 1301. It is also possible to pass a copper wire through the curling element 1301. The curling element 1301 may e.g. be made from a plastic material.

In the illustration of FIG. 13, the curling element 1031 is therefore plotted as a dash-dotted line to express that, after having been rolled up, all of the suitable curling elements can be retained by bending the copper wire accordingly. Particularly, this concerns also curling elements other than those that have been explained in connection with the other figures. When the extension 1308 is bent after the curling elements 1301 have been rolled into the hair strand, the extension acts as a retaining element which prevents the curling element 1301 from unrolling.

However, the curling elements can also be retained in the known manner by a rubber band which extends from the one end of the curling element to the other end and can be fastened to the two ends.

Figure 14:
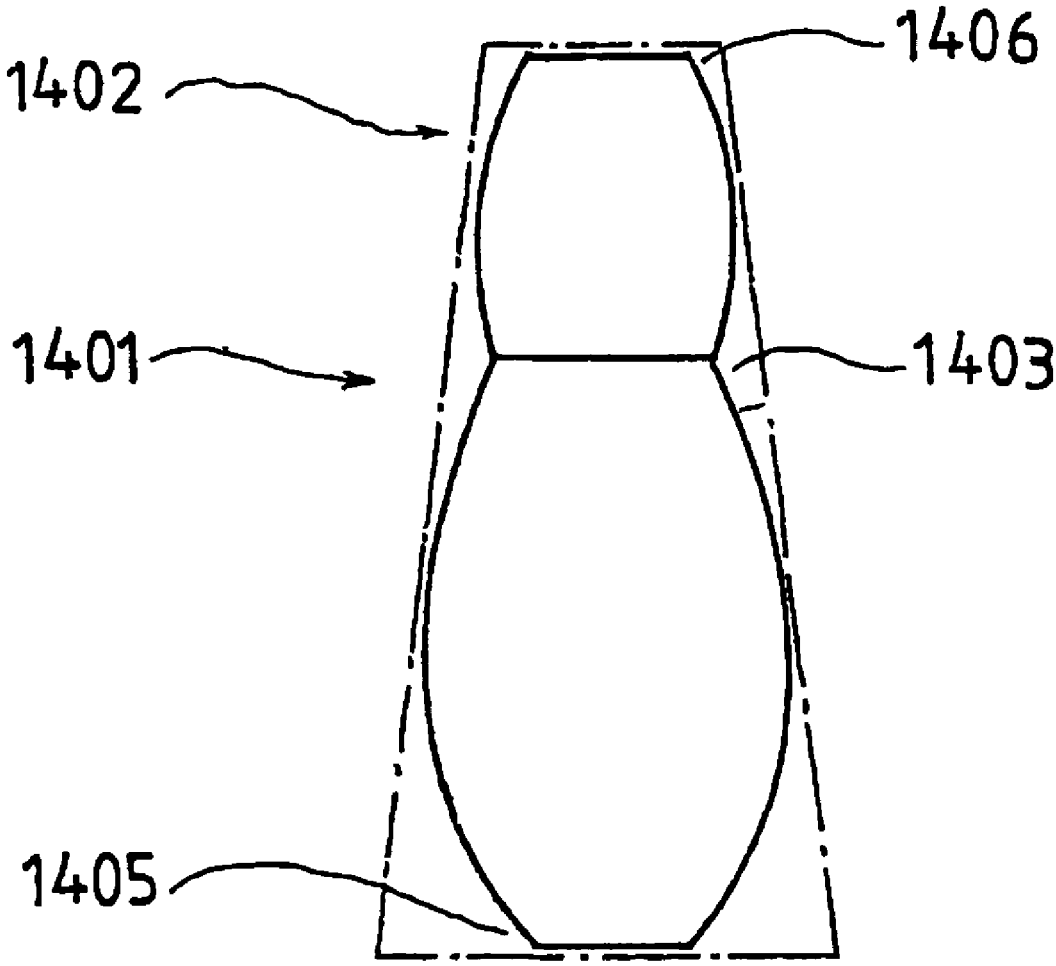
FIG. 14 shows another embodiment of a curling element.

FIG. 14 shows a further design of the curling element according to the illustration of FIG. 4. In contrast to the curling element of the illustration of FIG. 4, it can be seen in the illustration according to FIG. 14 that the tapers at the ends 1405 and 1406 are so pronounced that the radii at the ends 1405 and 1406 are smaller than the radius at the notch 1403. The two resulting ellipsoids between the notch 1403 and the end 1406 and between the notch 1403 and the end 1405 may have different sizes again. The enveloping lateral surface 1402 of the cylinder is again tapered from the one end 1405 to the other end 1406. One of the ellipsoids, or also both ellipsoids, may again be flattened here.

The illustrated curling elements may have any desired sizes. Curling elements have turned out to be advantageous that have an overall length of several centimeters. This overall length may e.g. be between 5 cm and 10 cm. The diameters may also be of a few centimeters and e.g. range from 1 cm to about 5 cm. The notches may have a depth of a few centimeters in comparison with the lateral surface of the cylinder, the depth ranging e.g. from about 1 cm to 2 cm. The tapers at the ends may be reduced by about up to 1 cm in comparison with the maximum diameters. It becomes apparent from the embodiment of FIG. 14, that the tapers may be more pronounced and may also be several centimeters. In the illustrated embodiment of FIG. 14, the diameter of the lower ellipsoid to the end 1405 was tapered by about 2 cm to 3 cm.

Figure 15:
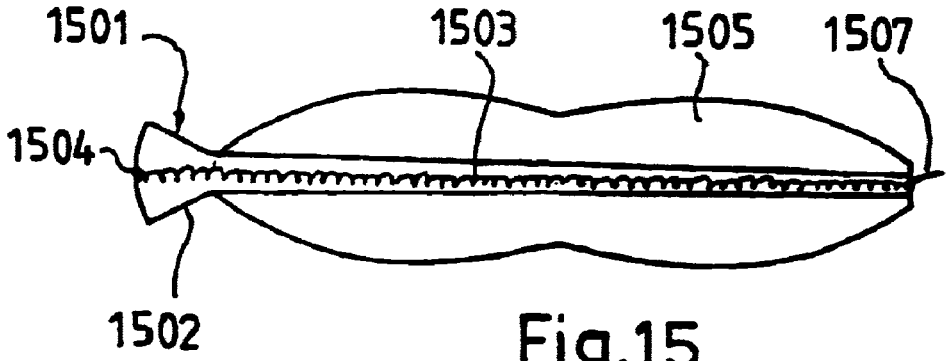
FIG. 15 shows a partial view of a curling element having a tubular member embedded therein.

FIG. 15 shows a retaining element 1501 having a tubular member 1502 and a member 1503 of an elastic material. The member 1503 is configured such that in the relaxed state it fully disappears in the tubular member 1502. In this case it should still be possible to grip the member for tensioning and fastening. To this end, the member 1503 is fastened to the end of the tubular member 1502 that is the right one in the drawing. The member 1503 is then dimensioned such that in the relaxed state it is not longer than the tubular member 1502. At the same time, the member 1503 must still be extensible to a length that is about twice the length of the tubular member 1502. As a consequence, the member 1503 can be extended to such an extent out of the tubular member 1502 that it can be placed externally around the tubular member 1502 and the hair wound therearound and can be fastened again with its front end 1504 to the side of the retaining element 1502 that is the right one in the drawing, or to the corresponding end of the curling element.

As can be seen from FIG. 15, the tubular member 1502 has, at least over part of its length, such an expansion of the inner diameter that the tubular member 1502 offers enough accommodating space to the member 1503 in the relaxed state.

FIG. 15 further shows how the tubular member 1502 is embedded in a curling element 1505. The tubular member 1502 can e.g. be cast into the curling element 1505 during production.

The member 1503 may e.g. be a rubber band. If necessary, the band may additionally be wound in the manner of a spiral spring to promote the necessary shortening in the state where there is no tensile load.

Furthermore, a fastening element 1506 may be provided at the rear end of member 1503. The fastening element 1506 may be designed to prevent the member 1503 from slipping into the tubular member 1502. To this end, the fastening element may have a larger diameter than the inner diameter of the tubular member in the corresponding end portion of the tubular member 1502, which is shown in the drawing at the right side.

Furthermore, the fastening element 1506 may be designed such that the front end 1504 of the member 1503 can be fastened to the fastening element 1506 at the rear end of the member 1503 in the tensioned state.

It is also advantageous when the tubular member 1502 has a funnel-shaped enlargement at the end at which the member 1503 exits from the tubular member 1502 (shown at the left side in the drawing), the edges being furthermore rounded off in an advantageous manner. As a result, when member 1503 is stretched or tensioned for fastening the curling element 1505, kinks in the member 1503 are avoided that might otherwise shorten the service life because the member 1503 would be subjected to a great load in the area of the kinks. The funnel-shaped enlargement can prevent the member 1503 from fully slipping into the curling element 1505.

Figure 16:
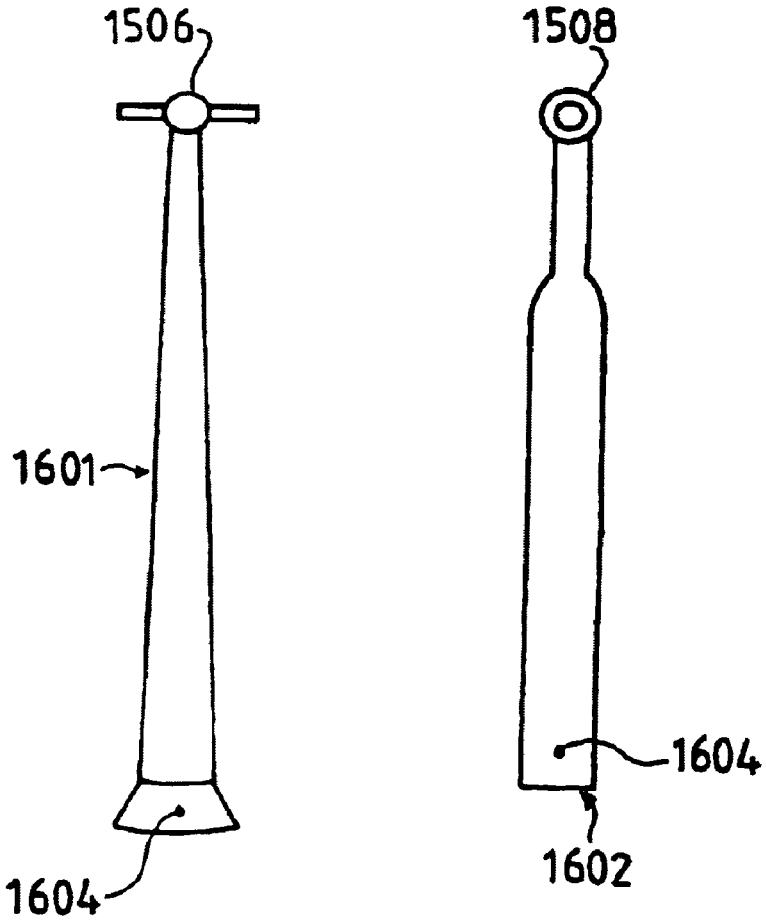
FIG. 16 shows embodiments of the tubular member.

FIG. 16 shows various embodiments of the member 1503 consisting of the elastic material.

For example, the member may have a step-like enlargement as shown in connection with reference numeral 1602. The member designated by reference numeral 1602 is provided at its rear end with a ring-shaped eyelet 1508. With this ring-shaped eyelet 1508, it is possible to hold the member when it is subjected to a tensile load. To this end, the ring-shaped eyelet must be larger than the inner diameter of the opening in the curling element. A slipping of the member through the element can then be prevented thereby. When the member is subjected to a tensile load, the rear thinner portion will expand to a greater extent than the front portion. Advantageously, the portion which is tensioned over the hair and the curling element on the outside is thus stretched less strongly than the portion positioned inside the curling element. Possible damage to the hair is thereby prevented in an advantageous manner. Furthermore, the member 1602 is provided at its front end with a hole 1604 with which the member can be fastened in the tensioned state to a hook of the curling element.

In accordance with the illustration 1601, the member may also have an increased inner diameter over the whole length. In this illustration of the member, it can further be seen that the fastening element 1506 has two hooks onto which the hole 1604 of the front member can be hung in the tensioned state.

Figure 17:
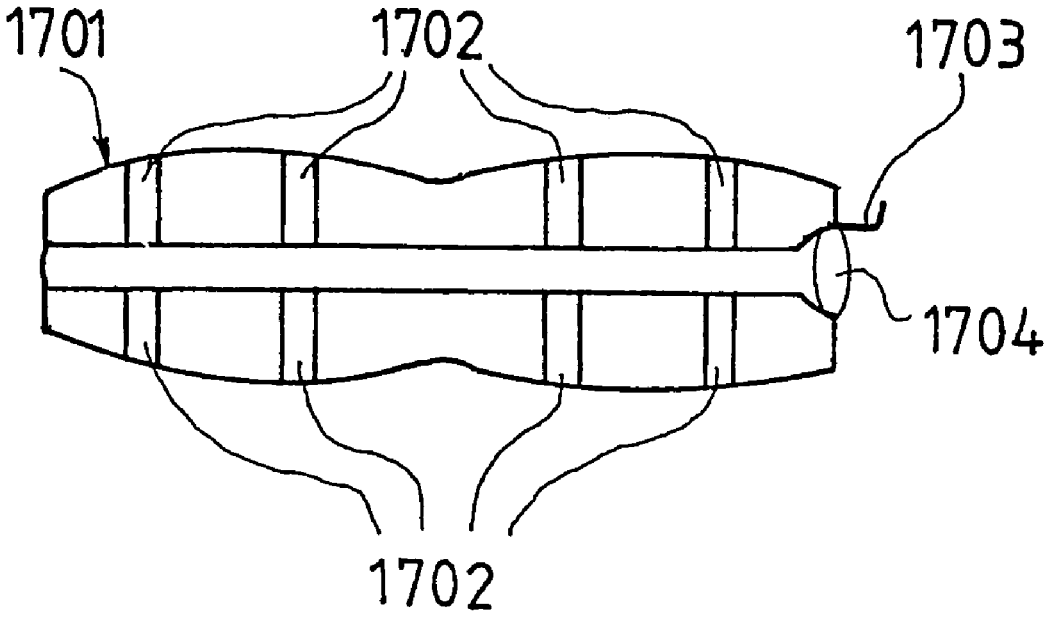
FIG. 17 shows yet another embodiment of the curling element.

In accordance with the illustration of FIG. 17, the curling element 1701, regarding the through hole in the interior, may be provided with reinforcing ribs 1702. If the reinforcing ribs 1702 are made from a sufficiently rigid plastic material, the wall of the through-hole may also be made from the material. The retaining element can then be finished in advance and inserted during production of the curling element.

In case the member of the elastic material comprises a fastening member according to reference numeral 1506 or 1508, a corresponding receiving means 1704 may advantageously be formed in the through-hole at one end. The member consisting of the elastic material is retained by the appropriate fastening members 1506, 1508 in the appropriate receiving means 1704. The curling element may advantageously be provided with a hook 1703 in which the hole 1604 can be hung in the front portion of the member consisting of the elastic material.

Advantageously, the material as such, or due to its shape, is configured in a way that the portion of the member that is located in the curling element in the stretched stage is expanded more strongly than the portion located outside the curling element. Advantageously, the member is designed, at least in the area located outside the curling element in the stretched state, in such a manner that there are no sharp or rigid edges found there so as to avoid marks in the hair or other damage.

In the front portion, the member consisting of the elastic material is enlarged to prevent any slipping into the opening of the curling element. With hole 1604, the member can then be mounted on a hook 1703 provided on the curling element, or also on a fastening member 1506.

In the area of the hole 1604, the member consisting of the elastic material may have any other desired geometrical shape as well. Such shapes may e.g. be a half moon, a triangle, a circle, an ellipsoid, a square, or the like. These shapes, however, should have such dimensions that the member is prevented from slipping into the opening of the curling element.

As an alternative to the illustrated embodiments, it is also possible to design the retaining element such that it comprises two elastic members which in the extended state are interconnected to prevent the curling element from unrolling.

It is evident that the above-described retaining elements can also be used in curling elements having shapes differing from those disclosed herein.

This is also true for the reinforcing ribs as illustrated in FIG. 17, which ribs may also be used in other curling elements in a corresponding way.

The invention claimed is:

1. A curling element for styling hair, said curling element having first and second ends and at least essentially a cylindrical basic form, wherein at least one ring-shaped notch is formed in the cylindrical basic form, the bottom of the at least one ring-shaped notch and transitions of the ring-shaped notch being rounded off in a cylindrical lateral surface, wherein the transitions of the at least one ring-shaped notch into the cylindrical lateral surface comprise 1) at least two essentially resulting ellipsoids formed between the ring-shaped notch and the ends of the curling element, or 2) plural ones of the essentially resulting ellipsoids formed between first and second ones of the at least one ring-shaped notch and between the respective ring-shaped notches and the respective ends of the curling element, and, wherein the curling element is tapered at both ends of the curling element and the radius of the cylindrical basic form decreases constantly from the one end of the curling element to the other end to have a frusto-conical envelope shape.

2. The curling element according to claim 1, wherein the at least two essentially resulting ellipsoids are flattened at two opposite sides along the length thereof.

3. A curling element for styling hair, the curling element having at least essentially a cylindrical basic form and first and second ends, wherein the cylindrical basic form has provided therein a helical notch which is rounded in its bottom portion and in a transition to a cylindrical lateral surface, wherein the helical notch extends only over a portion of the cylindrical basic form of the curling element, and a bottom of said notch is provided at a smaller radial distance from an axis of said cylindrical basic form than said cylindrical lateral surface, and wherein the helical notch is spaced inwardly from both the first and second ends of the curling element.

4. The curling element according to claim 3 wherein the radius of the cylindrical lateral surface decreases along a length of the curling element including at one of said ends.

5. The curling element according to claim 3, wherein the helical notch projects into the basic form and is surrounded about its entire length and ends by the cylindrical lateral surface to form a closed notch.

6. A curling element in combination with a retaining element, the curling element having at least essentially a cylindrical basic form with first and second ends and a passage extending therethrough with openings at the first and second ends, the retaining element including at least an elastic member of an elastic material, the retaining element co-acting with the curling element such that said elastic member, in its relaxed state, is positioned at least almost entirely inside the passage of said curling element, the elastic member being extensible by a tensile load from the curling element, the elastic member in the extended state being adapted to be fastened with its front end to the retaining element or to the curling element, said elastic member having different diameters along the length thereof so that when the elastic member is subjected to a tensile load, the length of the elastic member within the passage expands to a greater extent than the length of the member outside of the passage that is tensioned and secured to the other end of the curling element.

7. The combination of claim 6, wherein said elastic member has a hole at a first end that is transverse to the length of said elastic member and a fastening element at a second end for insertion into the hole.

8. The combination according to claim 6, wherein said elastic member has a hole at a first end to receive a hook of the curling element and an eyelet at the second end that is larger than a diameter of the passage.

9. The combination according to claim 6, wherein the diameter of said elastic member continuously increases a constant amount from the first end to the second end along the entire length thereof.

10. The combination according to claim 6, wherein the elastic member has a first radius along a first length thereof and a second different radius along a second length thereof inside the passage.

11. The curling element according to claim 6, wherein said elastic member extends through and outwardly from both ends of the passage of the curling element when tensioned.

12. The curling element according to claim 6, wherein in its relaxed state the elastic member extends through and outwardly from both ends of the passage of the curling element.

* * * * *